US008128263B2

(12) United States Patent
Higuchi et al.

(10) Patent No.: US 8,128,263 B2
(45) Date of Patent: Mar. 6, 2012

(54) LIGHT SOURCE UNIT AND LIGHTING APPARATUS HAVING LIGHT-EMITTING DIODES FOR LIGHT SOURCE

(75) Inventors: Kazunari Higuchi, Yokohama (JP); Sumio Hashimoto, Yokosuka (JP); Takayoshi Moriyama, Miura (JP); Shinichi Kumashiro, Yokohama (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 65 days.

(21) Appl. No.: 12/559,520

(22) Filed: Sep. 15, 2009

(65) Prior Publication Data

US 2010/0067226 A1 Mar. 18, 2010

(30) Foreign Application Priority Data

Sep. 16, 2008 (JP) ..... 2008-236242

(51) Int. Cl.
*F21V 29/00* (2006.01)

(52) U.S. Cl. ... 362/373; 362/294; 362/547; 362/249.02; 362/345; 257/712

(58) Field of Classification Search ..... 362/294, 362/373, 345, 249.02, 346
See application file for complete search history.

(56) References Cited

U.S. PATENT DOCUMENTS

| | | | | |
|---|---|---|---|---|
| 4,254,453 | A | 3/1981 | Mouyard | |
| 4,641,222 | A | 2/1987 | Derfiny | |
| 5,400,229 | A | 3/1995 | Lin | |
| 5,519,596 | A | 5/1996 | Woolverton | |
| 5,767,576 | A | 6/1998 | Kobayashi et al. | |
| 6,367,949 | B1 | 4/2002 | Pederson | |
| 6,422,716 | B2 | 7/2002 | Henrici | |
| 6,498,708 | B2 | 12/2002 | Schilloff | |
| 6,552,658 | B1 * | 4/2003 | Roller et al. | 340/475 |
| 6,840,654 | B2 | 1/2005 | Guerrieri | |
| 7,207,695 | B2 | 4/2007 | Coushaine | |
| 7,357,541 | B2 | 4/2008 | Gamache | |
| 7,549,772 | B2 | 6/2009 | Wang | |
| 7,722,227 | B2 | 5/2010 | Zhang | |
| 7,806,562 | B2 | 10/2010 | Behr | |
| 7,824,077 | B2 | 11/2010 | Chen | |
| 7,932,909 | B2 | 11/2010 | Wang | |
| 7,845,829 | B2 | 12/2010 | Shaner | |
| 7,918,591 | B2 | 4/2011 | Lynch | |

(Continued)

FOREIGN PATENT DOCUMENTS

| | | |
|---|---|---|
| CN | 2639704 | 9/2004 |

(Continued)

OTHER PUBLICATIONS

Extended European Search Report mail Mar. 29, 2010 issue in EP Appl ication 09011772.

(Continued)

*Primary Examiner* — Ali Alavi
(74) *Attorney, Agent, or Firm* — DLA Piper LLP US

(57) ABSTRACT

A light source unit is provided with a substrate and segments of a reflector. The substrate has a plurality of light-emitting devices mounted on its central and peripheral portions. The segments correspond to the light-emitting devices, individually. The segment corresponding to the light-emitting devices mounted on the central portion are higher in thermal radiation capacity than the segment corresponding to the light-emitting devices mounted on the peripheral portion.

8 Claims, 12 Drawing Sheets

U.S. PATENT DOCUMENTS

| | | | | |
|---|---|---|---|---|
| 2003/0156416 | A1 | 8/2003 | Stopa | |
| 2004/0014338 | A1 | 1/2004 | Takai et al. | |
| 2005/0128744 | A1 | 6/2005 | You | |
| 2006/0062127 | A1 * | 3/2006 | Burghardt et al. | 369/121 |
| 2007/0223218 | A1 | 9/2007 | You et al. | |
| 2008/0007955 | A1 | 1/2008 | Li | |
| 2008/0025028 | A1 | 1/2008 | Gloisten et al. | |
| 2008/0084701 | A1 | 4/2008 | Van de Ven | |
| 2008/0273341 | A1 | 11/2008 | Wilcox | |
| 2008/0278955 | A1 | 11/2008 | Boyer | |
| 2009/0021931 | A1 | 1/2009 | Mayer | |
| 2009/0097249 | A1 | 4/2009 | Lee | |
| 2009/0231849 | A1 | 9/2009 | Tseng | |
| 2009/0244894 | A1 | 10/2009 | Zhou | |
| 2009/0284972 | A1 | 11/2009 | Chang | |
| 2010/0118541 | A1 | 5/2010 | Li | |
| 2010/0214790 | A1 | 8/2010 | Wu | |
| 2010/0259919 | A1 | 10/2010 | Khazi | |
| 2011/0075411 | A1 | 3/2011 | Van De Ven | |
| 2011/0096556 | A1 | 4/2011 | Alexander | |

FOREIGN PATENT DOCUMENTS

| | | | |
|---|---|---|---|
| CN | 2665920 | | 12/2004 |
| CN | 1921231 | | 2/2007 |
| CN | 201072101 | | 6/2008 |
| DE | 197 21 061 | | 11/1997 |
| DE | 10 2004 028211 | | 12/2005 |
| EP | 1030099 | | 8/2000 |
| EP | 1767967 | | 3/2007 |
| EP | 1772668 | | 4/2007 |
| EP | 1950 491 | | 7/2008 |
| EP | 2163809 | A2 * | 3/2010 |
| JP | 2001313260 | A * | 11/2001 |
| JP | 2006-172895 | | 6/2006 |
| JP | 2006-228932 | | 8/2006 |
| JP | 2009-64637 | | 3/2009 |
| WO | WO 2007/028397 | | 3/2007 |

OTHER PUBLICATIONS

U.S. Appl. No. 12/548,947.
U.S. Appl. No. 12/624,958.
U.S. Appl. No. 12/473,447.
U.S. Appl. No. 12/885,030.
English Abstract of JP 2009-064637 published Mar. 26, 2009.
Machine English language translation of JP 2009-064637 published Mar. 26, 2009.
Extended 2010 Search Report issued in EP 00177305.9 on Dec. 28, 2010.
Chinese Office Action issued in CN Appl. No. 2010110800539310 on Nov. 11, 2010.
English Language Translation of Chinese Office Action issued in CN Appl. No. 2010110800539310 on Nov. 11, 2010.
English Language Abstract of CN 2665920 published Dec. 22, 2004.
European Search Report issued in EP Appln. 09007089.7 on Jan. 18, 2011.
English Language Abstract of DE 10 2004 028211 published Dec. 29, 2005.
English Language Abstract of DE 197 21 061 published Nov. 27, 1997.
European Search issued in EP Appl 09011025.5 on Oct. 22, 2009.
English language abstract of JP 2006-172895, published Jun. 29, 2006.
Machine English language translation of JP 2006-172895, published Jun. 29, 2006.
English Abstract of JP-2006-228932 published Aug. 31, 2006.
Machine English language translation of JP-2006-228932 published Aug. 31, 2006.
U.S. Appl. No. 12/548,947.
U.S. Appl. No. 12/624,958.
U.S. Appl. No. 12/473,447.
English language Abstract of JP 2001-313260, published Nov. 9, 2001.
Machine English language translation of JP 2001-313260, published Nov. 9, 2001.
Chinese Office Action issued in CN200910223690.6 on dated Jan. 19, 2011.
English Translation of Chinese Office Action issued in CN200910223690.6 on dated Jan. 19, 2011.
English Language Abstract of CN 201072101 published Jun. 11, 2008.
English Language Abstract of CN 1921231 Published Feb. 28, 2007.
English Language Abstract of CN 2639704 published Sep. 8, 2004.
Image File Wrapper of U.S. Appl. No. 12/624,958 between Oct. 18, 2011 and Jan. 17, 2012 electronically captured on Jan. 18, 2012.
Image File Wrapper of U.S. Appl. No. 12/473,447 between Oct. 18, 2011 and Jan. 17, 2012 electronically captured on Jan. 18, 2012.

* cited by examiner

LIGHT SOURCE UNIT AND LIGHTING APPARATUS HAVING LIGHT-EMITTING DIODES FOR LIGHT SOURCE

CROSS-REFERENCE TO RELATED APPLICATIONS

This application is based upon and claims the benefit of priority from prior Japanese Patent Application No. 2008-236242, filed Sep. 16, 2008, the entire contents of which are incorporated herein by reference.

BACKGROUND OF THE INVENTION

1. Field of the Invention

The present invention relates to a light source unit adapted for use in a lighting apparatus having light-emitting devices, such as light-emitting diodes (LEDs), and the lighting apparatus using the light source unit.

2. Description of the Related Art

A light-emitting device such as an LED has properties that its light output and service life are reduced as its temperature increases. For a lighting apparatus that uses solid-state light-emitting devices, such as LEDs or EL devices, as its light sources, therefore, it is important to suppress the temperature increase of the devices, in order to extend or improve the service life or luminous efficiency of the apparatus. A lighting apparatus using LEDs as its light sources is disclosed in Jpn. Pat. Appln. KOKAI Publication No. JP2006-172895A. In this lighting apparatus, a substrate is attached to a mounting plate capable of heat dissipation. The mounting plate is fixed to a main body of the lighting apparatus at mounting portions that are located in a point-symmetric manner on the peripheral edge of the body. Heat generated in the substrate is transmitted to the main body of the lighting apparatus via the mounting plate. Thus, the heat-discharge rate of the substrate is improved.

In the lighting apparatus described in Jpn. Pat. Appln. KOKAI Publication No. JP2006-172895A, however, the heat is transmitted from the peripheral edge of the substrate to the main body. The heat production in and radiation from the substrate are balanced in a certain time after the light sources are turned on. Thus, the temperature distribution of the substrate is generally uniform.

Immediately after the light sources are turned on, however, the temperature of a central portion of the substrate is liable to increase. If the light sources are repeatedly turned on and off in this condition, the irregular temperature distribution immediately after the lighting causes a reduction in the service life or properties of the light-emitting devices mounted on the central portion of the substrate. For example, the luminance of the light-emitting devices mounted on the central portion of the substrate inevitably becomes lower than that of the devices on a peripheral portion. Primarily, moreover, heat generated in the central portion of the substrate cannot be easily radiated without regard to the elapsed time after the light sources are turned on, which is another provocative condition for temperature increase.

BRIEF SUMMARY OF THE INVENTION

The present invention provides a light source unit, having a function to accelerate homogenization of the temperature distribution of a substrate on which a plurality of light-emitting devices are mounted, and a lighting apparatus using the light source unit.

A light source unit according to an aspect of the invention comprises a substrate and thermal radiation means. A plurality of light-emitting devices are mounted on a central portion of the substrate and a peripheral portion surrounding it. The thermal radiation means correspond-to the light-emitting devices, individually. The thermal radiation capacity of the thermal radiation means corresponding to the light-emitting devices mounted on the central portion is higher than that of the radiation means corresponding to the light-emitting devices mounted on the peripheral portion.

In the present invention, the definitions and technical meanings of terms are as follows unless otherwise specified. A light-emitting device is a solid-state light emitter, such as an LED or organic EL device. The light-emitting device should preferably be mounted by the chip-on-board method or surface mounting method. However, the present invention, by its nature, is not limited to any special mounting method. Further, there are no special restrictions on the number of mounted light-emitting devices or the substrate shape. The "central port-ion" and "peripheral portion" are not uniform or absolute concepts but relative ones that can be grasped according to the layout of the substrate and light-emitting devices.

For example, it may be configured so that the thermal radiation efficiency of the thermal radiation means corresponding to the devices becomes higher with distance from the outer periphery. Further, the radiation means may be formed of a reflector or wiring pattern of electrodes or the like. Alternatively, the radiation means may be arranged with some other special members. Furthermore, the radiation means corresponding to the light-emitting devices mounted on the central portion may be made of a material different from that of the ones on the peripheral portion.

If the thermal radiation means is a reflector, the reflector is provided with walls and reflective surfaces. The walls form projection apertures corresponding to the light-emitting devices, individually. The reflective surfaces include ones that are defined by the walls corresponding individually to the light-emitting devices mounted on the central portion and ones that are defined by the walls corresponding individually to the light-emitting devices mounted on the peripheral portion. Each reflective surface is spread from an incoming side on which the light-emitting devices are arranged toward an outgoing side on which light from the light-emitting devices is emitted. The area of each reflective surface on the central portion is greater than the area of each reflective surface on the peripheral portion. If a plurality of reflective surfaces are radially arranged, for example, they may be configured so that their respective areas gradually increase from the peripheral portion toward the central portion.

Alternatively, the thermal radiation means may include electrodes of a copper foil formed on an obverse side of the substrate on which the light-emitting devices are mounted. In this case, the electrodes include blocks thermally coupled corresponding individually to the light-emitting devices mounted on the central portion and blocks thermally coupled corresponding individually to the light-emitting devices mounted on the peripheral portion. The area of each of the blocks corresponding to the light-emitting devices mounted on the central portion is greater than that of each of the blocks corresponding to the light-emitting devices mounted on the peripheral portion.

Further, a lighting apparatus according to the invention comprises the light source unit described above and a main body provided with the light source unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
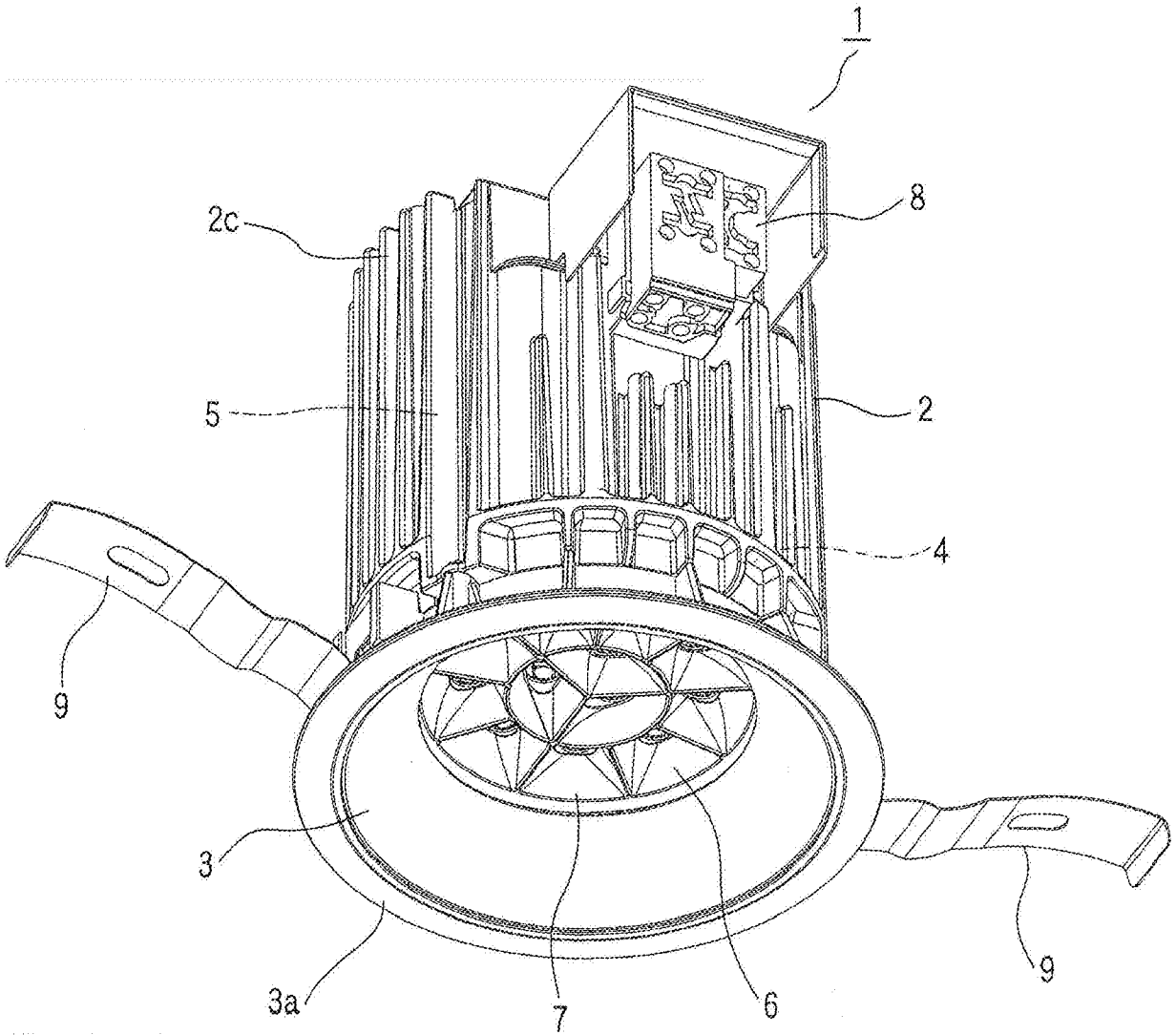
FIG. 1 is a perspective view showing a lighting apparatus according to a first embodiment of the invention.
Figure 2:
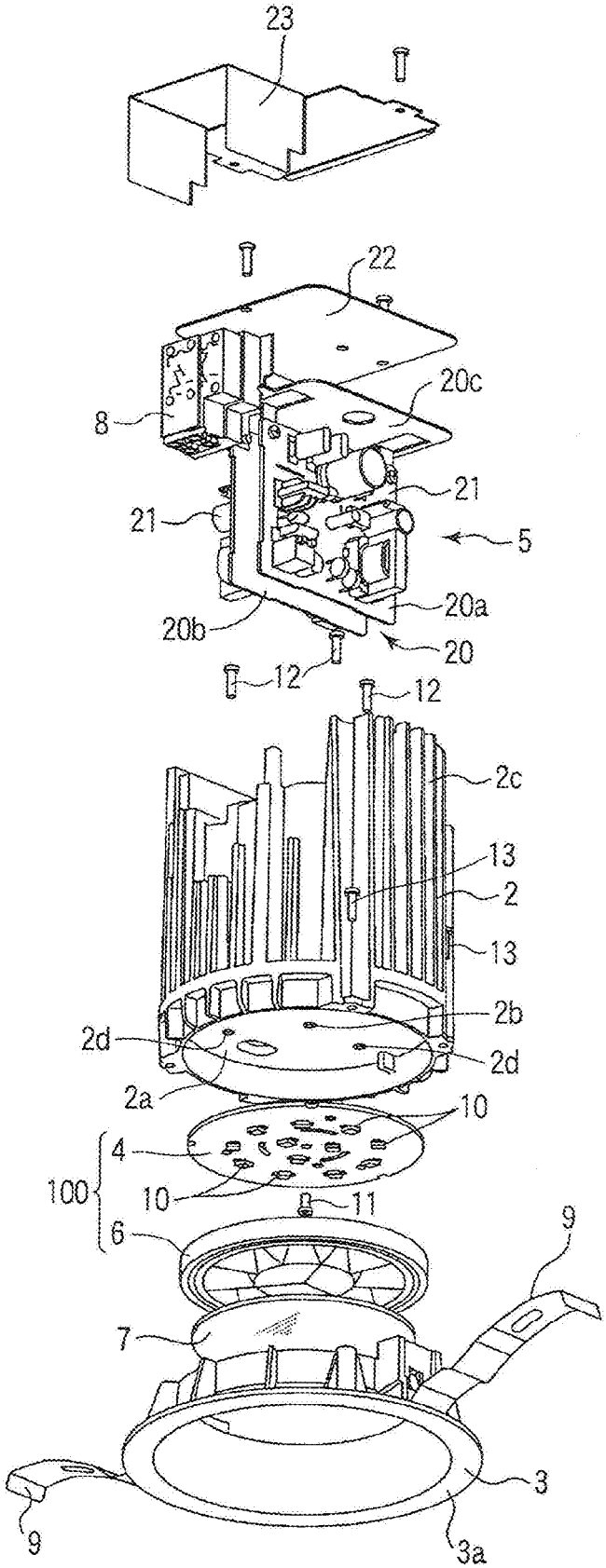
FIG. 2 is an exploded perspective view of the lighting apparatus shown in FIG. 1.

A light source unit 100 and a lighting apparatus according to a first embodiment of the present invention will now be described with reference to FIGS. 1 to 8. A down light 1 is an example of the lighting apparatus of a type that is embedded in a ceiling C. As shown in FIGS. 1 and 2, the down light 1 is provided with a main body 2, a light distributor 3, a substrate 4, a power source unit 5, a reflector 6, and a light-transmitting cover 7. In the present embodiment, "top" and "bottom" are defined with respect to the posture in which the down light 1 is used. Further, "front" or "obverse" is used herein to designate the side on which light is emitted, and "rear", "reverse" or "back" to designate the opposite side.

Figure 6:
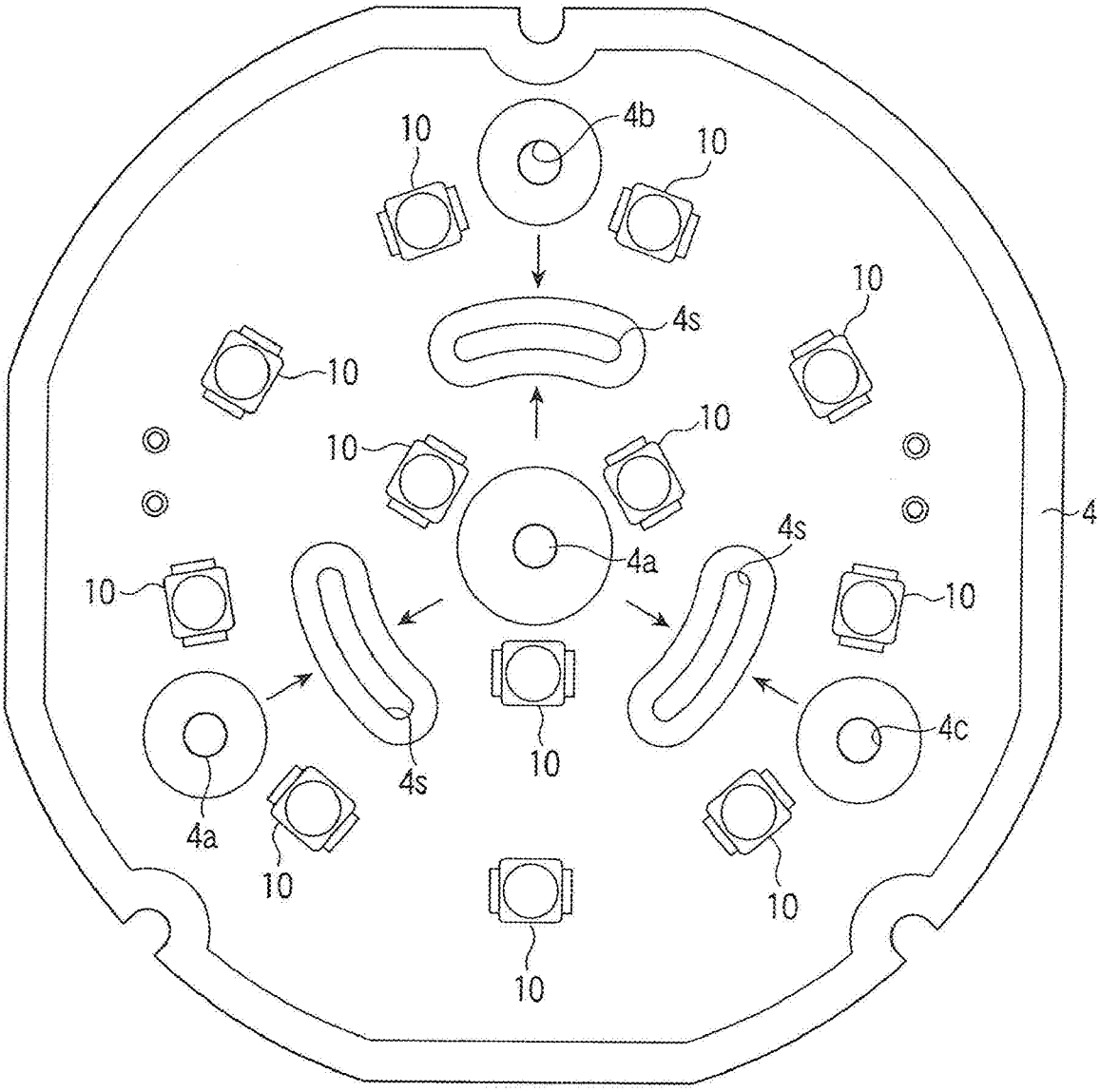
FIG. 6 is a plan view of a surface of a substrate shown in FIG. 2.
Figure 8:
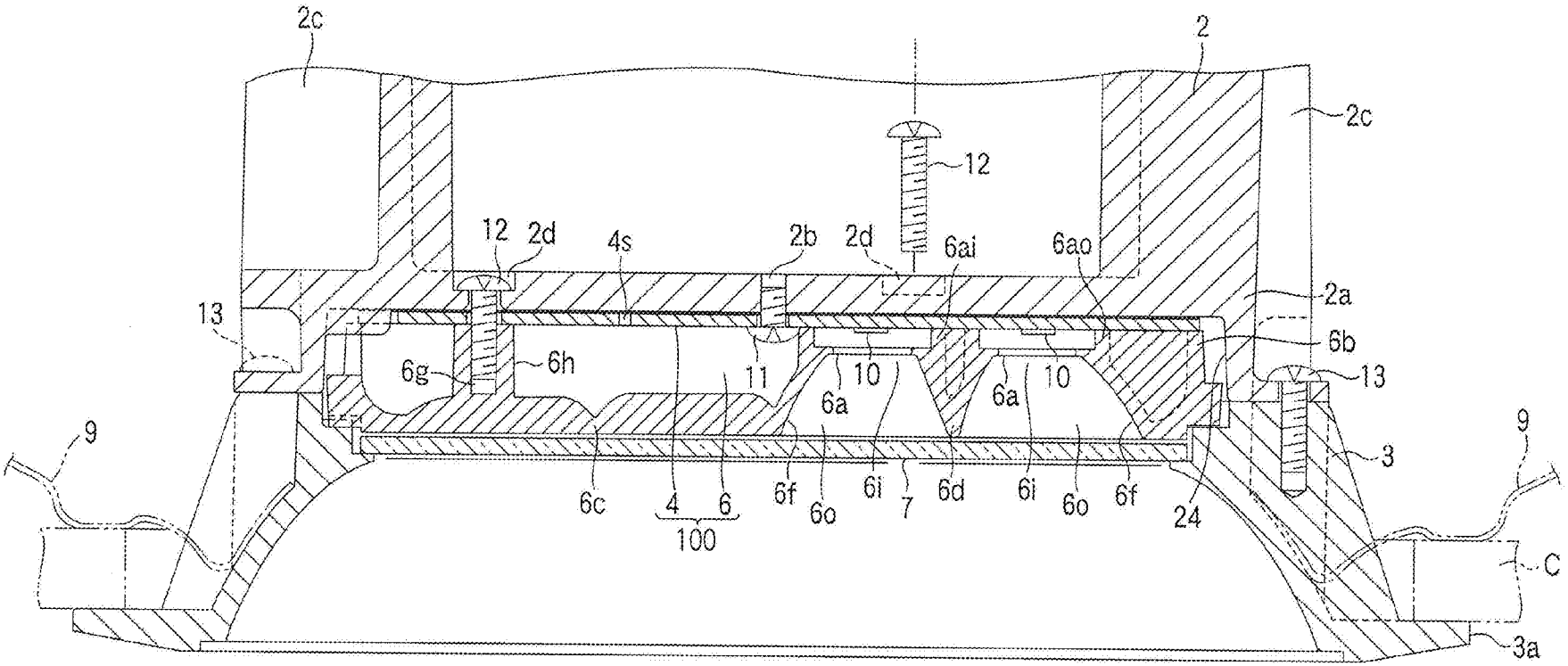
FIG. 8 is a sectional view of the lighting apparatus with its substrate, reflector, and light distributor shown in FIG. 2 assembled to a main body.

The main body 2 is a cylindrical structure of a thermally conductive material including a bottom wall 2*a*. As shown in FIGS. 2 and 8, a recess is formed in the bottom wall 2*a* to provide a mounting portion 24. As shown in FIG. 8, the light distributor 3 is mounted around the mounting portion 24 of the main body 2. As shown in FIGS. 2 and 6, LEDs 10 for use as light-emitting devices are mounted on the substrate 4, which is attached to the mounting portion 24 of the main body 2. As shown in FIG. 2, the power source unit 5 includes a circuit module 20 contained in the main body 2. As shown in FIG. 2 and 8, the reflector 6 is assembled to the main body 2 with the substrate 4 therebetween. As shown in FIGS. 2 and 8, the light-transmitting cover 7 is located in front of the reflector 6. The cover 7 may be white, translucent, or diffusive. As shown in FIG. 1, moreover, the main body 2 has a terminal block 8 on its outer surface. The light distributor 3 is provided with a pair of leaf springs 9 to be fixed to a panel of the ceiling C. The light source unit 100 is composed of the substrate 4 and reflector 6.

The main body 2 is formed of a highly electrically conductive material, e.g., a die casting of aluminum alloy. The outer surface of the main body 2 is finished by baking a white melamine-based paint. The main body 2 may be formed of any other suitable material that assures thermal conductivity. The main body 2 has a plurality of radiator fins 2*c* extending vertically outward from its outer surface. The main body 2 has a central threaded hole 2*b* and peripheral through-holes 2*d* in the mounting portion 24 of its bottom wall 2*a*. The central threaded hole 2*b* opens downward and is formed with a female thread on its inner peripheral surface. The peripheral through-holes 2*d* penetrate the bottom wall 2*a* in its thickness direction. The main body 2 contains the power source unit 5.

As shown in FIG. 2, the power source unit 5 is provided with the circuit module 20, formed of two circuit boards 20*a* and 20*b*, and a holding plate 20*c* on which the circuit boards 20*a* and 20*b* are mounted. The circuit module 20 is mounted with electrical components 21, such as a control IC, transformer, and capacitor, and is inserted into the main body 2 from above. Thereafter, a cover 22 is put on the main body 2 from above and attached thereto by screws, whereupon the circuit boards 20*a* and 20*b* are sealed in the main body 2. Further, a top plate 23 is attached to the cover 22 from above. The circuit module 20 is electrically connected to the substrate 4 on which the LEDs as the light-emitting devices are mounted. The circuit module 20 includes a power circuit and serves to on/off-control the light-emitting devices. The power source unit 5 is connected to the terminal block 8 that is exposed to the outside of the main body 2. The terminal block 8 is connected to the commercial power supply.

As shown in FIG. 2, the light distributor 3 is formed of acrylonitrile-butadiene-styrene (ABS) resin and has a downwardly spread bevel shape. The light distributor 3 is formed integrally on an open end portion at which an annular flange 3*a* is spread as a decorative frame, and its upper end portion is fixed to the main body 2. The pair of leaf springs 9 are attached to the outer peripheral surface of the light distributor 3. As shown in FIG. 8, the leaf springs 9 serve as anchors for fixing the down light 1 to the panel of the ceiling C.

Figure 7:
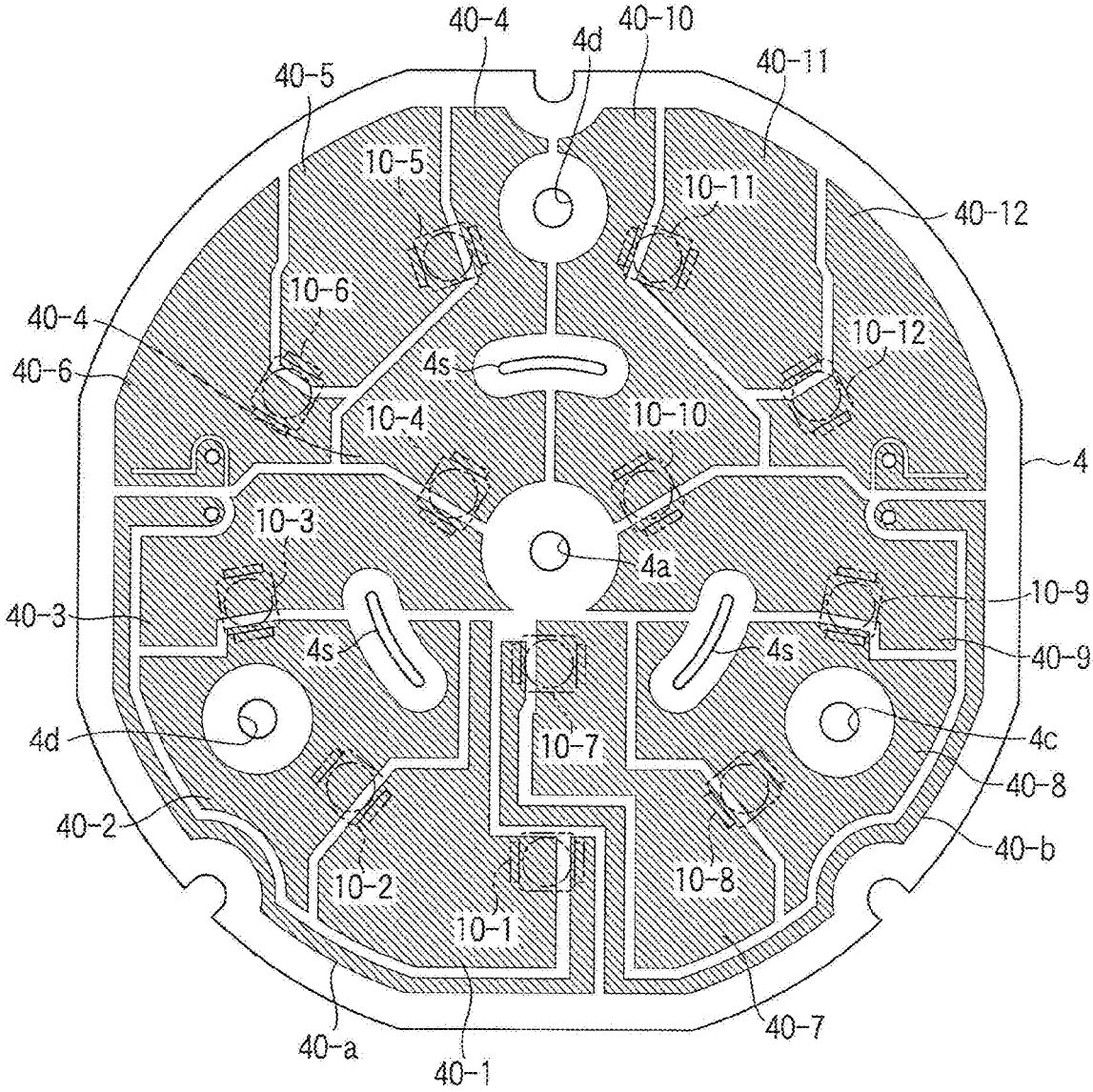
FIG. 7 is a pattern diagram of electrodes of the substrate shown in FIG. 6.

The substrate 4 will be described with reference to FIGS. 6 and 7. FIG. 6 shows the obverse side of the substrate 4. FIG. 7 shows relationships between electrode patterns formed on the obverse side of the substrate 4 and the layout of the LEDs 10. As shown in FIGS. 6 and 7, the substrate 4 is provided with a plurality of LEDs 10 as light sources on its obverse side. In the present embodiment, twelve LEDs 10 in total are arranged by a surface mounting method, three in a central region and nine around them. The substrate 4 is a circular flat plate of glass-epoxy resin, an insulating material.

As shown in FIG. 7, the obverse side of the substrate 4 is covered substantially entirely by electrodes 40 to which the LEDs 10 are connected. Each electrode 40 is formed of a copper foil and doubles as a radiator plate (thermal radiation means) of each LED 10 connected thereto. As shown in FIG. 7, therefore, the electrodes 40 are divided into blocks 40-1 to 40-12 such that the temperature distribution over the substrate 4 is substantially uniform when heat generated by the LEDs 10 is radiated.

Further, the reverse side of the substrate 4 is entirely covered by a layer of highly electrically conductive material, e.g., copper layer. The copper layer is insulated from a circuit for the LEDs 10 mounted on the substrate 4. The heat generated by the glowing LEDs 10 is diffused throughout the substrate 4 by the copper layer and radiated. By diffusing the heat, the copper layer prevents the heat from being locally applied to the substrate 4, thereby homogenizing a thermal stress on the substrate 4. Furthermore, the substrate 4 is a multilayered structure including resist layers suitably laminated as required.

The substrate 4 is thermally bonded to the mounting portion 24 on the bottom wall 2*a* of the main body 2 by closely contacting it. As this is done, the substrate 4 may be coupled to the bottom wall 2*a* of the main body 2 with an adhesive between them. The adhesive used is a material with high thermal conductivity, e.g., a mixture of a silicone-based adhesive and metal oxide or the like. The adhesive should only be able to bring the substrate 4 into close contact with the bottom wall 2*a*. Therefore, the adhesive may be a simple flexible sheet-like member, curable resin, or the like.

As an insulating material other than glass-epoxy resin, a ceramic material or some other plastic material may be used for the substrate 4 only if it has relatively good thermal radiation properties and high durability. If a metallic material is used for the substrate 4, on the other hand, aluminum alloy is preferable because of its light weight, as well as high thermal conductivity and excellent thermal radiation properties.

Further, the substrate 4 has a plurality of fixing portions through which central and peripheral fixing means for fixing the substrate 4 to the main body 2 are passed. A central through-hole 4*a* is a fixing portion in the center of the substrate to which the central fixing means is attached. In the present embodiment, three outer peripheral through-holes 4*b* to 4*d* are fixing portions on the periphery of the substrate 4 to which the peripheral fixing means are attached. The outer peripheral through-holes 4*b* to 4*d* are arranged at intervals of 120° around the central through-hole 4*a*.

The substrate 4 has gentle arcuate slots 4*s* on a circle between the central through-hole 4*a* and outer peripheral through-holes 4*b* to 4*d*. The slots 4*s* are provided as thermal expansion absorbing means for absorbing extension of the substrate 4 by heat. Specifically, the slots 4*s* are formed individually on segments that connect the central through-hole 4*a* to the outer peripheral through-hole 4*b* to 4*d* so as to extend across the line segments. Further, additional slots may be formed individually on line segments that connect adjacent pairs of outer peripheral through-holes 4*b* and 4*c*; 4*c* and 4*d*; and 4*d* and 4*b* so as to extend across the line segments, that is, radially in this case.

The substrate 4 is fixed to the main body 2 by the central and peripheral fixing means at spots corresponding to the central through-hole 4*a* and outer peripheral through-holes 4*b* to 4*d*. The substrate 4 is exposed to a heat cycle such that it is heated while the LEDs 10 are on and releases heat after the LEDs 10 are turned off. Thus, the substrate 4 repeatedly receives stresses generated by expansion and contraction. In this case, stresses that are attributable to thermal expansion and act in the directions indicated by arrows in FIG. 6 are mitigated by the slots 4*s*. Since the stresses on the substrate 4 can be lightened, unexpected warp or deformation of the substrate 4 can be suppressed. Further, the stresses act little on the substrate 4, since it is free without being fixed with respect to radial directions other than the directions from the central through-hole 4*a* toward the outer peripheral through-holes 4*b* to 4*d*.

As shown in FIG. 7, the copper-foil electrodes 40 are composed of first to twelfth blocks 40-1 to 40-12 and two lead patterns 40-*a* and 40-*b* on the obverse side of the insulating substrate 4. LEDs 10-1 to 10-12 are connected spanning each corresponding two of the blocks 40-1 to 40-12 and lead patterns 40-*a* and 40-*b*. In order to clearly show the positional relationships between the LEDs 10-1 to 10-12 and the blocks 40-1 to 40-12 of the electrodes 40, the LEDs 10-1 to 10-12 are indicated by two-dot chain lines. The LEDs 10 are classified in two groups each including six LEDs connected in series. A first group is composed of the LEDs 10-1 to 10-6, and a second group of the LEDs 10-7 to 10-12.

In the first group, the anode and cathode of the LED 10-1 are connected to the lead pattern 40-*a* and first block 40-1, respectively. Heat generated by the LED 10-1 is thermally coupled so as to be transmitted to the first block 40-1. The anode and cathode of the LED 10-2 are connected to the first and second blocks 40-1 and 40-2, respectively. Heat generated by the LED 10-2 is thermally coupled so as to be transmitted to the second block 40-2. The LEDs 10-3 to 10-6 are connected in series in like manner.

In the second group, moreover, the anode and cathode of the LED 10-7 are connected to the lead pattern 40-*b* and seventh block 40-7, respectively. Heat generated by the LED 10-7 is thermally coupled so as to be transmitted to the seventh block 40-7. The anode and cathode of the LED 10-8 are connected to the seventh and eighth blocks 40-7 and 40-8, respectively. Heat generated by the LED 10-8 is thermally coupled so as to be transmitted to the eighth block 40-8. Likewise, the LEDs 10-9 to 10-12 are connected in series between the eighth to twelfth blocks 40-8 to 40-12.

Heat generated by each of the LEDs 10-1 to 10-12 is liable to be confined in the central portion of the substrate 4. Therefore, each of those blocks 40-4, 40-7 and 40-10 of the electrodes 40 which are located near the center of the substrate 4 is formed so that its area is greater than that of each of the surrounding blocks. Specifically, the respective areas of the blocks 40-4, 40-7 and 40-10 to which the LEDs 10-4, 10-7 and 10-10 on the central portion are thermally coupled are made greater so that the temperature distribution throughout the substrate 4 is uniform. Thus, the central blocks 40-4, 40-7 and 40-10 are higher in thermal radiation capacity than the peripheral blocks.

As shown in FIGS. 2 to 5, the reflector 6 is located on the obverse side of the substrate 4, that is, on the side where the LEDs 10 are mounted, and is formed of white polycarbonate or acrylonitrile-styrene-acrylate (ASA) resin. The reflector 6 has a function to control the distribution of light emitted from the LEDs 10 to ensure efficient irradiation. As shown in FIGS. 3A, 3B, 4A and 5, the reflector 6 is in the form of a disk having projection apertures 6*a* corresponding in position to the LEDs 10 mounted on the substrate 4. In the present embodiment, the projection apertures 6*a* are twelve in number.

Figure 4A:
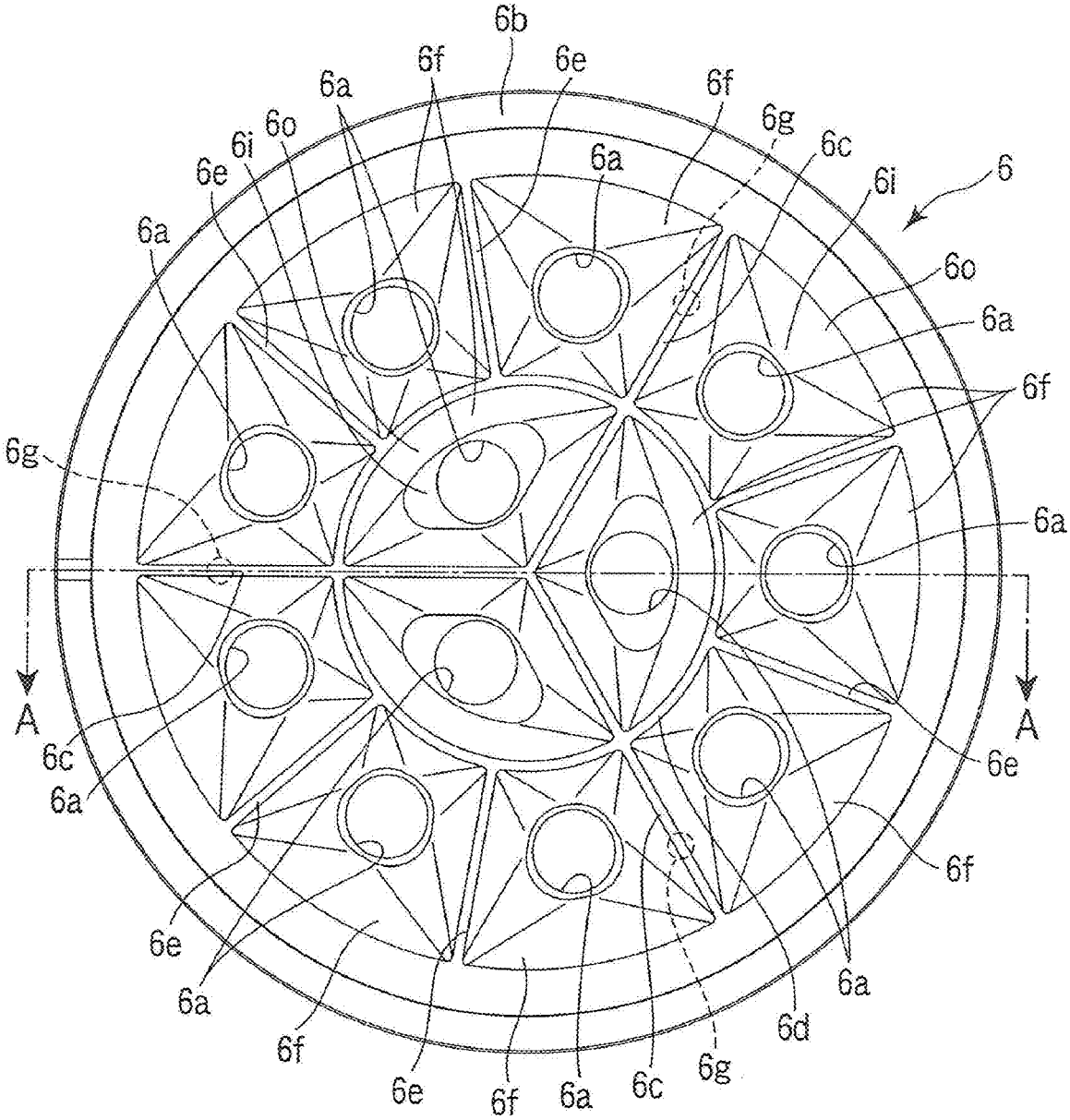
FIG. 4A is a plan view of the reflector shown in FIG. 2 taken from the outgoing side.

As shown in FIG. 8, the reflector 6 has a ring-shaped outer peripheral edge portion 6*b* that can be fitted in the mounting portion 24 of the main body 2. As shown in FIG. 4A, moreover, the projection apertures 6*a* are individually partitioned by radial walls 6*c*, inner peripheral wall 6*d*, and parting walls 6*e*. The radial walls 6*c* radially extend from the central portion to the outer peripheral edge portion 6*b* through the projection apertures 6*a* corresponding individually to the three central LEDs 10 and are arranged at circumferential intervals of about 120°. The inner peripheral wall 6*d* is a circular structure that is located between the central portion and outer peripheral edge portion 6*b*, that is, between the projection apertures 6*a* corresponding to the three LEDs 10 near the center and the projection apertures 6*a* corresponding to the nine surrounding LEDs 10, and halves the radial walls 6*c*. The parting walls 6*e* are located in pairs between the outer peripheral edge portion 6*b* and those parts of the inner peripheral wall 6*d* situated between the radial walls 6*c*.

Thus, the reflector 6 is formed with the six parting walls 6*e*. Specifically, the parting walls 6*e* individually subdivide those nine projection apertures 6*a* which correspond to the nine LEDs 10 located near the outer periphery of the substrate 4 and are divided in three triples by the radial walls 6*c*.

Figure 4B:
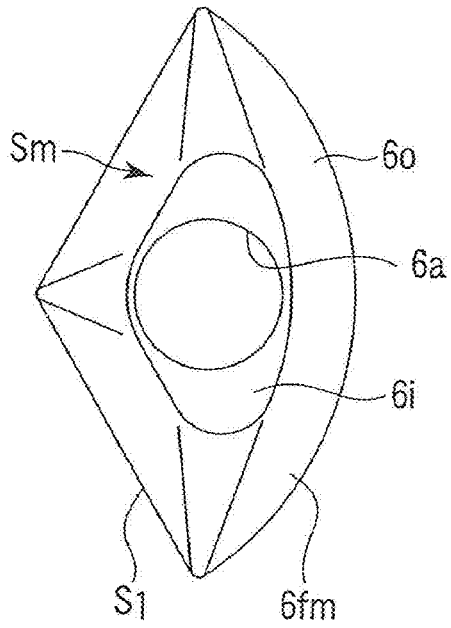
FIG. 4B is a plan view of a segment of a reflective surface on the inner peripheral side of the reflector shown in FIG. 4A.
Figure 4C:
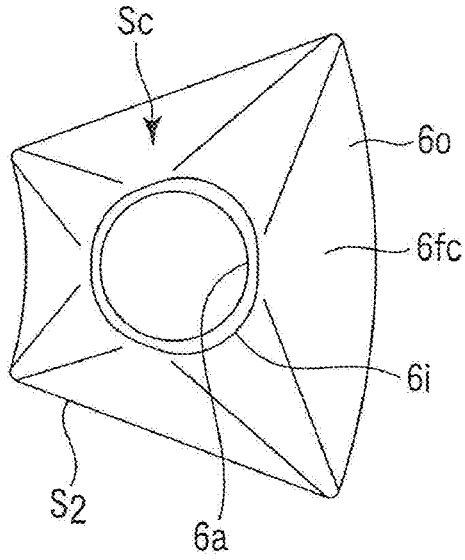
FIG. 4C is a plan view of a segment of a reflective surface on the outer peripheral side of the reflector shown in FIG. 4A.
Figure 5:
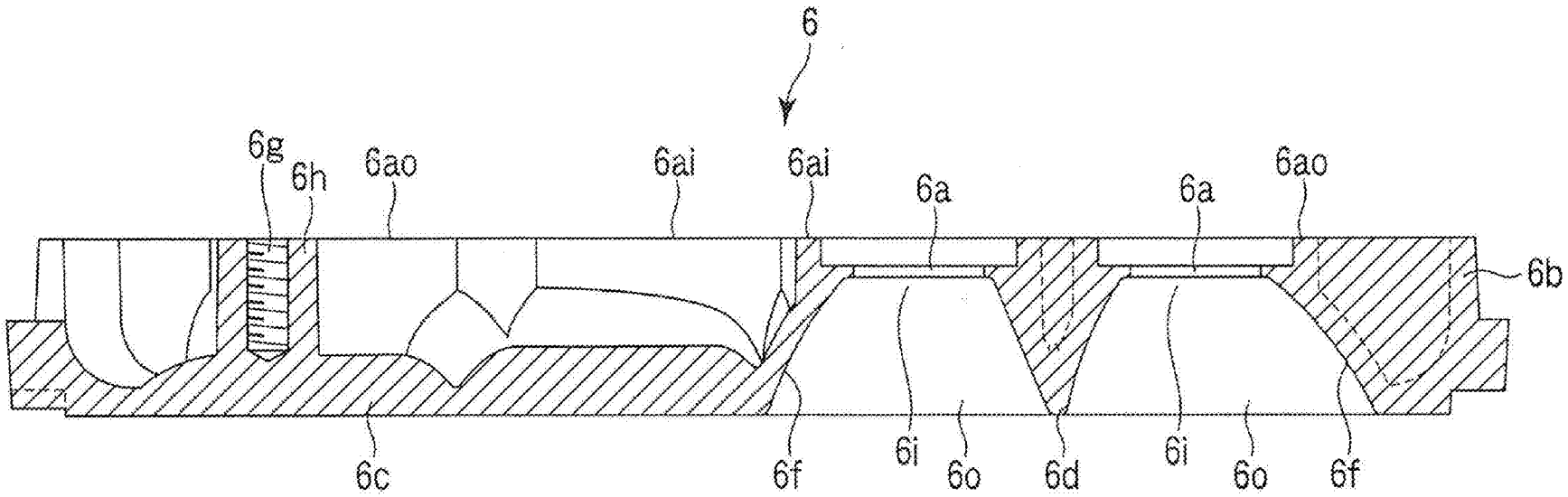
FIG. 5 is a cross sectional view taken along line A-A of FIG. 4A.

In the reflector 6 constructed in this manner, the radial wall 6*c*, inner peripheral wall 6*d*, and parting wall 6*e* that define each projection aperture 6*a* form a bowl-shaped (parabolic) surface that is spread downward from an incoming side 6*i* toward outgoing side 6*o* of the projection aperture 6*a*, as shown in FIG. 5. A parabolic surface formed at each projection aperture 6*a* forms a reflective surface 6*f*. The radial wall 6*c*, inner peripheral wall 6*d*, and parting wall 6*e* are chevron-shaped as viewed from the outgoing side 6*o*. The planar shape of each outgoing side 6*o* that is defined by the respective ridges of the walls 6*c* to 6*e* is sectorial, as shown in FIG. 4B, for the three outgoing sides 6*o* inside the inner peripheral wall 6*d*, and is trapezoid, as shown in FIG. 4C, for the nine outside outgoing sides 6*o*.

A surface area Sm of a reflective surface 6*fm* of each of those three of the twelve projection apertures 6*a* which are located in the central portion inside the inner peripheral wall 6*d* is greater than a surface area Sc of a reflective surface 6*fc* of each of the nine surrounding projection apertures 6*a*. Specifically, the respective areas of the reflective surfaces 6*fm* and 6*fc* have a relation Sm>Sc. As typically shown in the bottom views of FIGS. 4B and 4C, moreover, a projection area S1 of the sectorial projection aperture 6*a* corresponding to the reflective surface 6*fm* is greater than a projection area S2 of the trapezoid projection aperture 6*a* corresponding to the reflective surface 6*fc*. Specifically, there is a relation S1>S2. Thus, in the reflector 6 for use as thermal radiation means, the surface area and projection area S1 of the reflective surface 6*fm* of each central projection aperture 6*a* are greater than the surface area and projection area S2 of the reflective surface 6*fc* of each peripheral projection aperture 6*a*.

Figure 3A:
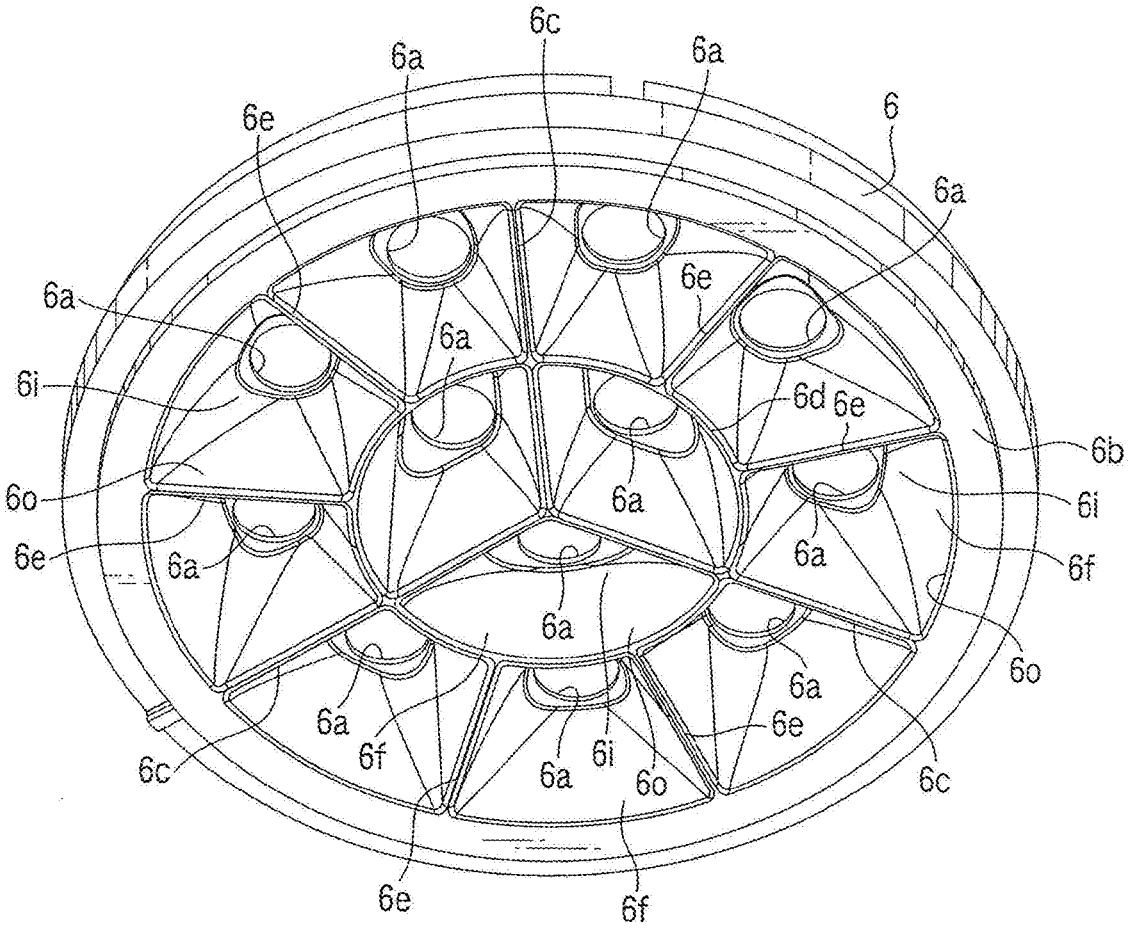
FIG. 3A is a perspective view of a reflector shown in FIG. 2 taken from an outgoing side.
Figure 3B:
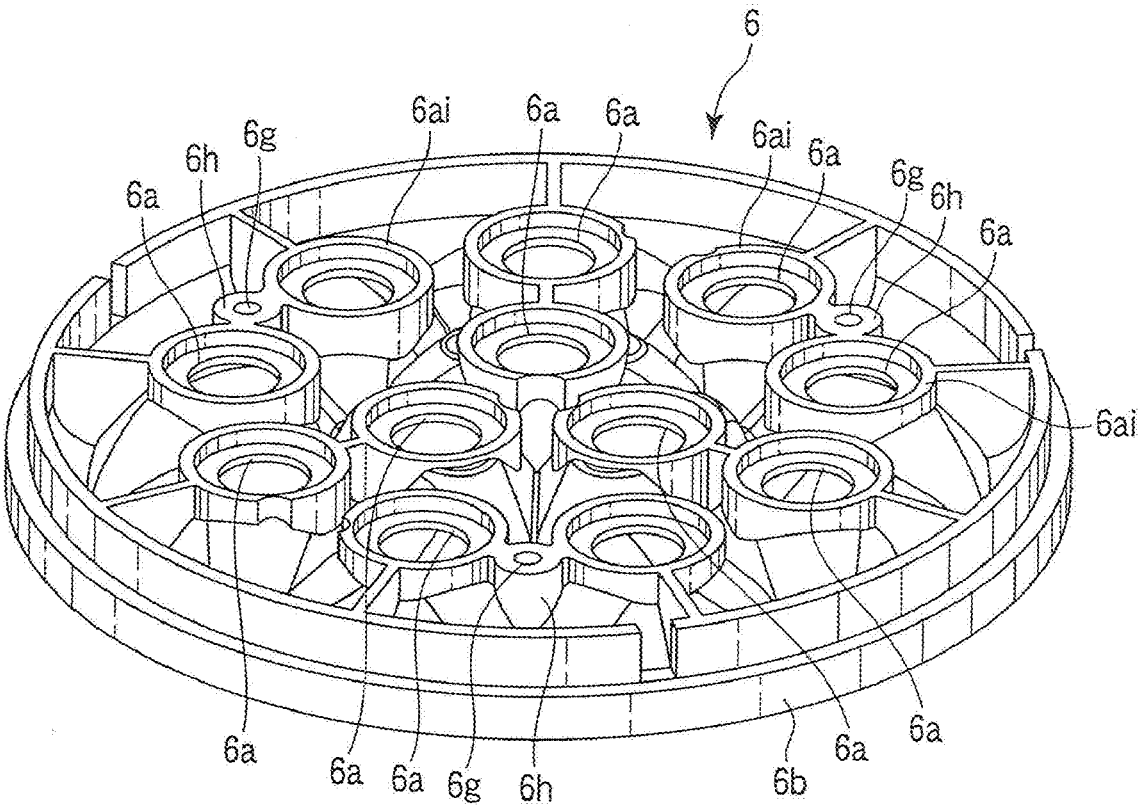
FIG. 3B is a perspective view of the reflector shown in FIG. 3A taken from an incoming side.

As shown in FIGS. 3B and 5, the reflector 6 includes stems 6*h* at those parts of the radial walls 6*c* on the substrate side which are located near the outer peripheral edge portion 6*b*. A single threaded hole 6*g* is bored through each stem 6*h* from the side that faces the substrate 4. As shown in FIG. 3B, the stems 6*h* and threaded holes 6*g* are formed at three spots of the reflector 6.

A method of assembling the light source unit 100, formed of the substrate 4 and reflector 6, to the mounting portion 24 of the main body 2 will now be described with reference to FIG. 8. In FIG. 8, the leaf springs 9 are partially omitted. As shown in FIG. 8, the mounting portion 24 on the bottom wall 2*a* of the main body 2 is formed so as to be able to closely contact the entire reverse side of the substrate 4. The stems 6*h* of the reflector 6 are arranged individually opposite the peripheral through-holes 2*d* of the main body 2 and the through-holes 4*b* to 4*d* of the substrate 4. The reverse side of the reflector 6 that faces the substrate 4 (especially the substrate-side end of the outer peripheral edge portion 6*b* of the reflector 6, edge portions 6*ai* and 6*ao* of the projection apertures 6*a*, and stems 6*h*) contact the obverse side of substrate 4 on which the LEDs 10 are mounted.

The substrate 4 and reflector 6 are fixed to the mounting portion 24 in the following procedure. First, the substrate 4 is fitted into the mounting portion 24 from below the main body 2. Then, a central screw 11 is threaded into the central threaded hole 2*b* in the bottom wall 2*a* through the central through-hole 4*a* from the obverse side of the substrate 4, whereupon the central portion of the substrate 4 is fixed to the main body 2. Subsequently, the periphery of the substrate 4 is fixed to the main body 2 by three peripheral screws 12. The peripheral screws 12 are tightened from above the main body 2 into the threaded holes 6*g* of the stems 6*h* on the reverse side of the radial walls 6*c* of the reflector 6 through the peripheral through-holes 2*d* of the bottom wall 2*a* and the through-holes 4*b* to 4*d* of the substrate 4. Thus, fixing the substrate 4 is completed the moment the reflector 6 is fixed by the peripheral screws 12 after the substrate 4 is positioned and tacked to the bottom wall 2*a* by the central screw 11, so that assembly work is easy.

The central screw 11 serves as central fixing means. The central fixing means should only be able to fix the substrate 4 to the main body 2. Therefore, the central screw 11 may be replaced with a combination of a stud bolt in the center of the mounting portion 24 and a nut to be screwed onto the bolt or a rivet to be driven into the center of the mounting portion 24. Further, the peripheral screws 12 serve as peripheral fixing means. The peripheral fixing means should only be able to secure the periphery of the substrate 4 and reflector 6 to the main body 2. Therefore, the peripheral screws 12 may be replaced with combinations of stud bolts on the stems 6*h* of the reflector 6 that project upward from the bottom wall 2*a* through the peripheral through-holes 2*d* and nuts that are screwed onto the stud bolts or rivets to be driven into the stems 6*h* of the reflector 6 through the peripheral through-holes 2*d* and through-holes 4*b* to 4*d* of the substrate.

The clamping force of the peripheral screws 12 acts in a direction to pull the reflector 6 toward the bottom wall 2*a*. The clamping forces of the central screw 11 to fix the substrate 4 and the peripheral screws 12 to pull the reflector 6 cooperate with each other to fix the substrate 4 firmly to the bottom wall 2*a*. In this state, the projection apertures 6*a* of the reflector 6 are opposed individually to the LEDs 10 of the substrate 4. Further, the obverse side of the substrate 4 on which the LEDs 10 are mounted closely contacts the reverse side of the reflector 6 pressed against it. As shown in FIG. 3B, the reverse side of the reflector 6 is formed with the edge portions 6*ai* and 6*ao* of the projection apertures 6*a* so as to surround the individual LEDs 10. These edge portions 6*ai* and 6*ao* are as high as the stems 6*h*. Therefore, the reflector 6 can press the reverse side of the substrate 4 against the mounting portion 24 of the bottom wall 2*a* of the main body 2 so as to cover the individual LEDs 10 mounted on the substrate 4.

The light distributor 3 is fixed to the main body 2 by mounting screws 13. The outside diameter of the flange 3*a* is greater than that of an embedding hole in the ceiling C. When the down light 1 is installed in the ceiling C, the flange 3*a* is caught by the peripheral edge of the embedding hole from below. The down light 1 of the present embodiment has the light-transmitting cover 7 of acrylic resin or the like between the light distributor 3 and reflector 6. The cover 7 is located in front of the reflector 6 from which light is emitted.

When the power source unit 5 is energized, in the configuration described above, a lighting circuit in the circuit module 20 is powered. When electric power is supplied to the substrate 4, the LEDs 10 emit light. Much of the light emitted from the LEDs 10 is transmitted through the cover 7 and irradiated forward. Some of the light is distribution-controlled by being temporarily reflected by the reflective surfaces 6*f* of the reflector 6 corresponding to the LEDs 10, and is transmitted through the light-transmitting cover 7 and irradiated forward.

Heat generated by the LEDs 10 is transmitted to the bottom wall 2*a* of the main body 2 through the reverse side of the substrate 4 in the main. This heat is transmitted up to an end of the main body 2 and radiated from the radiator fins 2*c* during the transmission. Further, the heat generated by the LEDs 10 is also diffused into the substrate 4 by the electrodes 40 that are formed covering the obverse side of the substrate 4, as shown in FIG. 7. The reverse side of the reflector 6 is brought into contact with the obverse side of the substrate 4 by radially extending ribs, as shown in FIG. 3B, as well by the edge portions 6*ai* and 6*ao* and stems 6*h*. Since the adhesion between the substrate 4 and reflector 6 is maintained, the heat diffused into the electrodes 40 is transmitted from the substrate 4 to reflector 6, that is, removed from the substrate 4.

Since the heat generated by the LEDs 10 is released to the main body 2 and reflector 6, the temperature distribution of the substrate 4 is made uniform. Further, the surface area Sm of each reflective surface 6*fm* on the central portion of the reflector 6 of this embodiment is greater than the surface area Sc of each reflective surface 6*fc* on the peripheral portion. Thus, a sufficient radiation area is provided corresponding to the central portion of the substrate 4. Accordingly, the temperature distribution of the substrate 4 is stable even at a time when heat is assumed to be concentrated on the central portion in the substrate temperature distribution immediately after the LEDs 10 are turned on. In the down light 1 as the light apparatus of the present embodiment, in consequence, the luminous flux is stabilized in an early stage after the LEDs 10 are turned on, and reduction of the service life of the LEDs 10 can be lessened.

In addition, the projection area S1 of the outgoing side 6*o* of the projection aperture 6*a* corresponding to the reflective surface 6*fm* is greater than the projection area S2 of the outgoing side 6*o* of the projection aperture 6*a* corresponding to the reflective surface 6*fc*. Also with this respect, the thermal radiation from the substrate 4 is accelerated to produce a remarkable effect. In the electrodes 40, the area of each of the blocks 40-4, 40-7 and 40-10 to which the LEDs 10-4, 10-7 and 10-10 on the central portion of the substrate 4 are thermally bonded is made greater than that of each surrounding blocks. Also with this regard, the thermal radiation from the central portion of the substrate 4 is accelerated to homogenize the temperature distribution of the substrate 4.

The substrate 4 may be deformed as it is repeatedly expanded and contracted by heat generated from the LEDs 10. Also in this case, the reverse side of the reflector 6 is pressed against the obverse side of the substrate 4, so that a stress acting to the substrate 4 attributable to the thermal expansion can be absorbed by the slots 4*s*. Thus, warp or deformation of the substrate 4 can be suppressed. The slots 4*s* display a function to suppress deformation attributable to the thermal expansion even in a reflow process, among the manufacturing processes, such as a reflow soldering process of the substrate 4.

According to the present embodiment, as described above, there may be provided the light source unit 100, capable of accelerating temperature equalization of the substrate 4 mounted with the LEDs 10, and the down light (lighting apparatus) 1 using the light source unit 100. According to this embodiment, moreover, the substrate 4 is pressed against the main body 2 by the reflector 6, so that heat can be efficiently radiated from the substrate 4, and deformation of the substrate 4 can be suppressed.

A down light 1 as a lighting apparatus according to a second embodiment of the present invention will now be described with reference to FIG. 9. This down light 1 is constructed substantially in the same manner as the down light 1 of the first embodiment, and the two embodiments differ only in the method of fixing the apparatus to the ceiling C. Therefore, the components that have same functions as the down light 1 according to the first embodiment will respectively applying the same reference symbols and may omit the description from followings.

The down light 1 is mounted on the ceiling C with the aid of a housing H. The housing H is fixed to ceiling joists that hold the panel of the ceiling C. The housing H is provided with slides H1 stretched between the joists and a hull H2 attached to the slides H1. The hull H2 has suspension brackets H3 on its inside.

Figure 9:
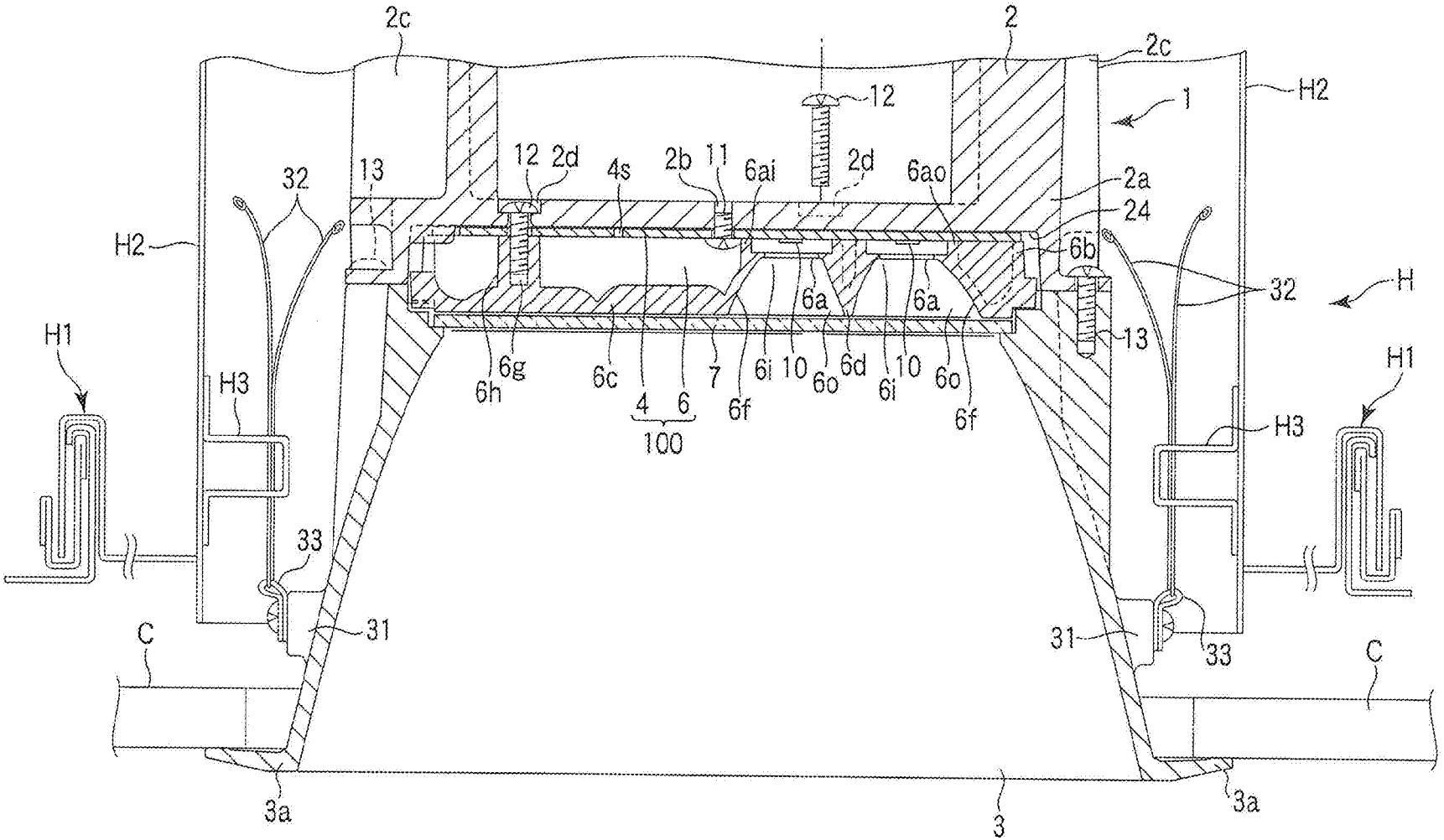
FIG. 9 is a sectional view of a lighting apparatus of a second embodiment of the invention with its substrate, reflector, and light distributor assembled to a main body.

As shown in FIG. 9, a light distributor 3 of the down light 1 includes bases 31 and formed wire springs 32 on its outer surface. The formed wire springs 32 are connected to their corresponding bases 31 by metal fittings 33, individually. Each formed wire spring 32 has elasticity such that it spreads out in a V-shape when in a free state and is passed through holes in the suspension bracket H3. As distal ends of the formed wire springs 32 passed through their corresponding suspension brackets H3 spread out, the down light 1 is fixed with its flange 3*a* caught by the panel of the ceiling C.

Since the down light 1 is fixed to the ceiling C by the housing H, its light distributor 3 is made longer than that of the down light 1 of the first embodiment in the direction of light emission. Further, the light distributor 3 is a die casting of aluminum alloy, which is a highly thermally conductive material like a main body 2. Since the light distributor 3 is greater than that of the first embodiment, its thermal capacity and radiation area are proportionally greater. The light distributor 3 is mounted on the bottom portion of the main body 2. The light distributor 3 absorbs and radiates heat generated by LEDs 10 via the main body 2. It is also advisable to increase the adhesion area by interposing a highly thermally conductive copper gasket or paste between the main body 2 and light distributor 3. Since the down light 1 can release more heat than that of the first embodiment, its heat can remove even if the heat generating value is increased by an increase of the LEDs 10 in number.

A down light 1 as a lighting apparatus according to a third embodiment of the present invention, which resembles those of the first and second embodiments, will now be described with reference to FIG. 10. The down light 1 of the present embodiment differs from those of the other embodiments in the method of fixing a substrate 4 to a mounting portion 24, and other configurations are the same as those of the first and second embodiments. Therefore, a repeated description of the same configurations as those of the first and second embodiments with reference to the corresponding drawings is omitted.

Figure 10:
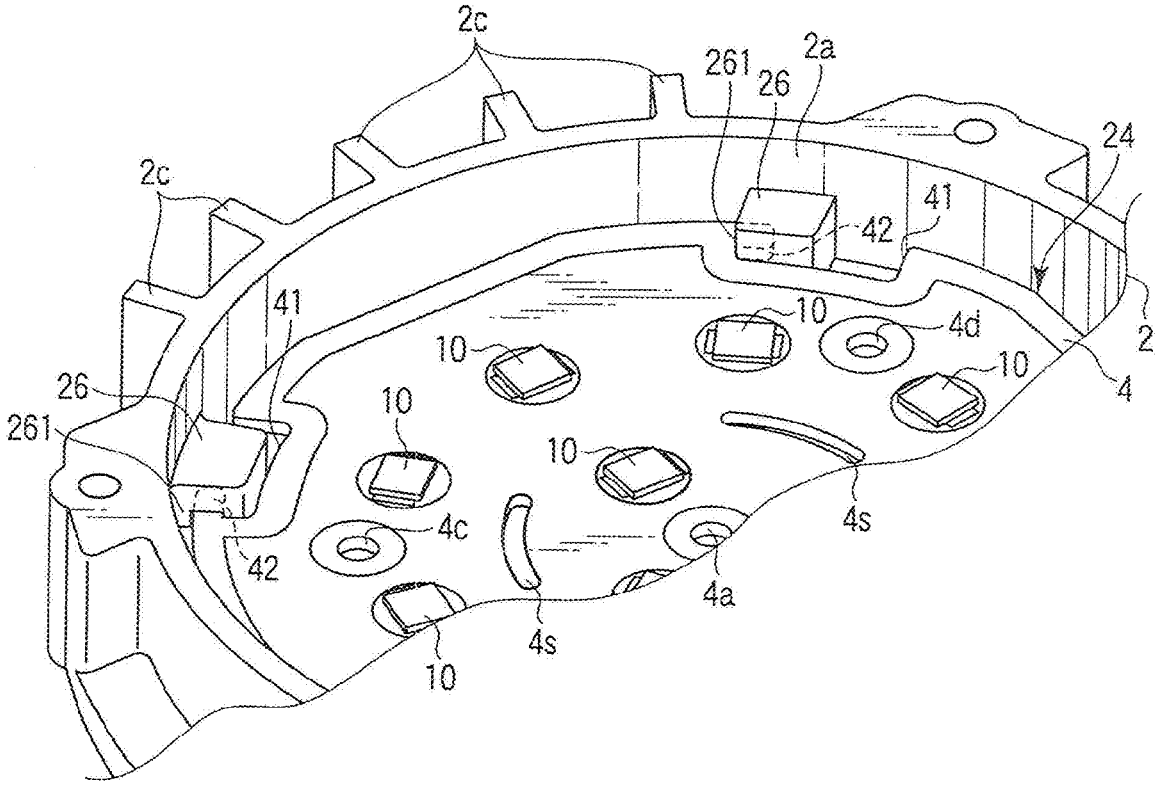
FIG. 10 is a perspective view showing a substrate of a lighting apparatus of a third embodiment of the invention fitted in a mounting portion of a main body.

FIG. 10 is a bottom view showing the substrate 4 attached to the mounting portion 24 on a bottom wall 2*a* of a main body 2. The main body 2 of the present embodiment includes engagement blocks 26 on an inner peripheral surface side wall of the mounting portion 24. Each engagement block 26 has a recess 261 opening in a circumferential direction around a central threaded hole 2*b* in the mounting portion 24. Further, the substrate 4 is provided with notch portions 41 and pawls 42. Each notch portion 41 is formed by removing a part of the substrate 4 lest the substrate 4 interfere with the engagement blocks 26 when it is fitted into the mounting portion 24. As shown in FIG. 10, each pawl 42 extends circumferentially from its corresponding notch portion 41 and is fitted into the recess 261 of its corresponding engagement block 26.

In attaching the substrate 4 to the main body 2, the substrate 4 is inserted into a position where it contacts the bottom of the mounting portion 24. Then, the pawls 42 are fitted into the recesses 261 of the engagement blocks 26 by turning the substrate 4 clockwise (in the case of the present embodiment)

with its reverse side held against the bottom of the mounting portion 24. The engagement blocks 26 are located individually in three positions oriented substantially corresponding to peripheral through-holes 2*d* arranged around the central threaded hole 2*b*. When the pawls 42 are fitted in their corresponding recesses 261, the substrate 4 just contacts the bottom surface of the mounting portion 24. With this arrangement, the substrate 4 can be easily attached to the main body 2. The main body 2 and substrate 4 of the present embodiment may also be used in either of the first and second embodiments.

The light distributor 3 of the down light 1 of the first embodiment, like that of the embodiment, may be formed of a die casting of aluminum alloy in place of ABS resin. Further, the reflector 6 of each of the first to third embodiments may be formed of a die casting of aluminum alloy, which is a highly thermally conductive material. If the reflector 6 is made of aluminum alloy, heat transmitted from the LEDs 10 can be further positively transmitted to the reflector 6 by the electrodes 40 that are formed substantially over the obverse side of the substrate 4. The heat transmitted to the reflector 6 is further transmitted to the light distributor 3, whereby the heat generated by the LEDs 10 can be radiated efficiently.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A light source unit comprising:

a substrate having a plurality of light-emitting devices mounted on a central portion and a plurality of light-emitting devices mounted on a peripheral portion thereof; and thermal radiation means corresponding to the light-emitting devices, individually, wherein the thermal radiation means corresponding to the light-emitting devices mounted on the central portion is higher in thermal radiation capacity than the thermal radiation means corresponding to the light-emitting devices mounted on the peripheral portion.

2. A light source unit according to claim 1, wherein the thermal radiation means comprises a reflector which is comprising:

walls which define projection apertures corresponding to the light-emitting devices, individually;

reflective surfaces defined by the walls individually for the light-emitting devices mounted on the central portion and spread from an incoming side on which the light-emitting devices are arranged toward an outgoing side on which light from the light-emitting devices is emitted; and reflective surfaces defined by the walls individually for the light-emitting devices mounted on the peripheral portion and spread from the incoming side on which the light-emitting devices are arranged toward the outgoing side on which the light from the light-emitting devices is emitted, wherein the reflective surface on the central portion has an area which is greater than an area of the reflective surface on the peripheral portion.

3. A light source unit according to claim 1, wherein the thermal radiation means comprises electrodes of a copper foil formed on an obverse side of the substrate on which the light-emitting devices are mounted, wherein the electrodes comprise:

blocks thermally coupled corresponding individually to the light-emitting devices mounted on the central portion; and blocks thermally coupled corresponding individually to the light-emitting devices mounted on the peripheral portion, wherein each of the blocks corresponding to the light-emitting devices mounted on the central portion has an area which is greater than an area of each of the blocks corresponding to the light-emitting devices mounted on the peripheral portion.

4. The light source unit according to claim 1, wherein the thermal radiation means comprise a light distributor which is mounted on the bottom portion of the main body, the light distributor absorbs and radiates heat generated by the light-emitting devices via the main body.

5. A lighting apparatus comprising:

a light source unit which is comprising:

a substrate having a plurality of light-emitting devices mounted on a central portion and a plurality of light-emitting devices mounted on a peripheral portion thereof; and thermal radiation means corresponding to the light-emitting devices, individually; and a main body provided with the light source unit, wherein the thermal radiation means corresponding to the light-emitting devices mounted on the central portion is higher in thermal radiation capacity than the thermal radiation means corresponding to the light-emitting devices mounted on the peripheral portion.

6. A lighting apparatus according to claim 5, wherein;

the thermal radiation means comprises a reflector which is comprising:

walls which define projection apertures corresponding to the light-emitting devices, individually;

reflective surfaces defined by the walls individually for the light-emitting devices mounted on the central portion and spread from an incoming side on which the light-emitting devices are arranged toward an outgoing side on which light from the light-emitting devices is emitted; and reflective surfaces defined by the walls individually for the light-emitting devices mounted on the peripheral portion and spread from the incoming side on which the light-emitting devices are arranged toward the outgoing side on which the light from the light-emitting devices is emitted, wherein the reflective surface on the central portion has an area which is greater than an area of the reflective surface on the peripheral portion.

7. A lighting apparatus according to claim 5; wherein, the thermal radiation means comprises electrodes of a copper foil formed on an obverse side of the substrate on which the light-emitting devices are mounted, wherein the electrodes comprise:

blocks thermally coupled corresponding individually to the light-emitting devices mounted on the central portion; and blocks thermally coupled corresponding individually to the light-emitting devices mounted on the peripheral portion, wherein each of the blocks corresponding to the light-emitting devices mounted on the central portion has an area which is greater than an area of each of the blocks corresponding to the light-emitting devices mounted on the peripheral portion.

8. The lighting apparatus according to claim 5; wherein, the thermal radiation means comprise a light distributor which is mounted on the bottom portion of the main body, the light distributor absorbs and radiates heat generated by the light-emitting devices via the main body.

* * * * *